US005597790A

United States Patent [19]

Thoen

[11] Patent Number: 5,597,790

[45] Date of Patent: Jan. 28, 1997

[54] LIQUID DETERGENT COMPOSITIONS CONTAINING A SUSPENDED PEROXYGEN BLEACH

[75] Inventor: Christiaan A. J. K. Thoen, Haasdonk, Belgium

[73] Assignee: The Procter & Gamble Company, Cincinnati, Ohio

[21] Appl. No.: 337,653

[22] Filed: Nov. 10, 1994

Related U.S. Application Data

[63] Continuation of Ser. No. 39,074, filed as PCT/US91/07606, Oct. 15, 1991, abandoned.

[30] Foreign Application Priority Data

Oct. 22, 1990 [EP] European Pat. Off. ..... 90870197

[51] Int. Cl.[6] ..... C11D 3/39; C11D 3/08

[52] U.S. Cl. ..... 510/303; 510/309; 510/418; 510/372; 252/186.27; 252/186.3; 252/186.43

[58] Field of Search ..... 252/99, 102, 104, 252/186.43, 186.3, 186.27

[56] References Cited

U.S. PATENT DOCUMENTS

| | | | |
|---|---|---|---|
| 4,240,920 | 12/1980 | de Luque | 252/99 |
| 4,377,489 | 3/1983 | King | 252/99 |
| 4,689,167 | 8/1987 | Collins et al. | 252/95 |
| 5,102,571 | 4/1992 | Mole et al. | 252/99 |
| 5,160,656 | 11/1992 | Carron et al. | 252/99 |

FOREIGN PATENT DOCUMENTS

| | | | |
|---|---|---|---|
| 0293040 | 11/1988 | European Pat. Off. . | |
| 0294904 | 12/1988 | European Pat. Off. . | |
| 0338921 | 10/1989 | European Pat. Off. . | |
| 0339998 | 11/1989 | European Pat. Off. | C11D 3/12 |
| 0368575 | 5/1990 | European Pat. Off. | C11D 3/39 |
| 2140822 | 12/1972 | France | C11D 7/00 |

*Primary Examiner*—Erin M. Harriman
*Attorney, Agent, or Firm*—Ken K. Patel; Michael D. Jones; George W. Allen

[57] ABSTRACT

Liquid detergent compositions are disclosed, which contain a solid peroxygen compound suspended in a liquid phase containing water and at least one water-miscible solvent, and low levels of silicate which provide adequate suspension for the solid peroxygen compound in the liquid phase.

11 Claims, No Drawings

LIQUID DETERGENT COMPOSITIONS CONTAINING A SUSPENDED PEROXYGEN BLEACH

This application is a continuation of application Ser. No. 08/039,074, filed as PCT/US91/07606 on Oct. 15, 1991, now abandoned.

TECHNICAL FIELD

The invention relates to liquid detergent compositions which contain a suspending solid peroxygen compound, and low levels of silicate.

BACKGROUND

Answering the long-felt need for bleach-containing aqueous liquid detergent compositions, European Patent Application 293 040 and 294 904, have described aqueous detergent compositions having a pH above 8, containing an anionic surfactant at conventional levels, and a solid peroxygen bleach, suspended in a specific water/solvent medium, which medium was found to give the required chemical stability to the composition.

In such compositions however, particular attention has to be given to the physical stability of suspended particles in the liquid medium.

One option is represented by e.g. copending U.K. Application No. 8926620.9, describing liquid detergent compositions in which solid particles, in particular particles of a peroxygen compound, are suspended by means of a structured surfactant phase (surfactant "neat phase"). There is a need, however, for suspending systems which involve easier processing, compared to structured surfactant phases.

Although not for the purpose of suspending peroxygen bleach particles, structured surfactant phases have been described in various patent documents. In particular EP-A-79 646, EP-A-86 614, EP-A-203 660 and EP-A-295 021 describe liquid detergent compositions containing suspended builder particles where one or more "salting-out" electrolytes, or "surfactant desolubilizing" electrolytes are used, to build structured phases with the surfactant materials.

Such electrolytes include, among many other substances, silicates, and need to be used at substantial levels, i.e. above 5%, in order to perform their "salting-out" effect.

Other patent documents disclosing the use of silicates in cleaning/detergent compositions of the suspending type include GB-A-2031455, and GB-A-1342612 wherein the solid materials to be suspended include abrasives and water-insoluble phosphate builder salts, but do not encompass peroxygen bleach particles. Actually, GB-A-2158453 which mentions perborate as a possible bleaching ingredient in liquid compositions of the suspending type specifically advocates that the compositions must be free of silicate, and instead must contain a carboxylic antigelling agent.

Silicates have also been widely described as alkalinity-building ingredients of aqueous thixotropic liquid compositions used for e.g. automatic dishwashing purposes. Representative of this art is EP 315 024, disclosing levels of silicate in the range of 25% to 40%.

It has now surprisingly been found that low levels of silicate can efficiently suspend peroxygen-bleach particles in liquid detergent compositions of the type described in EP-A-293 040, with only a moderate increase in the viscosity of the composition.

The present suspension system does not involve any specific processing difficulty; furthermore the presence of silicate brings such advantages as increased alkalinity and increased washing-machine compatibility.

The present invention therefore provides perfectly phase-stable aqueous liquid detergent compositions containing a solid peroxygen bleach compound, a liquid phase consisting of water and a water-miscible organic solvent, and low levels of silicate to suspend the peroxygen bleach particles in the liquid phase.

SUMMARY

The present invention relates to stable liquid detergent compositions having a pH of at least 8 and less than about 11, comprising a solid, water-soluble peroxygen compound suspended in a liquid phase containing water and at least one water-miscible organic solvent, the amount of the solid water-soluble peroxygen compound being such that the amount of available oxygen provided by said peroxygen compound is from 0.5% to 3%, such compositions containing from 0.5% to 5%, preferably 1% to 3%, by weight of silicate.

DETAILED DESCRIPTION

The water-soluble peroxygen compound

The water-soluble solid peroxygen compound is present in the compositions herein preferably at levels of from 5 to 50% by weight of the total composition, more preferably from 5 to 40%, even more preferably from 5% to 30%, most preferably from 10% to 30% by weight.

Examples of suitable water-soluble solid peroxygen compounds include the perborates, persulfates, peroxydisulfates, perphosphates and the crystalline peroxyhydrates formed by reacting hydrogen peroxide with sodium carbonate (forming percarbonate) or urea. Preferred peroxygen bleach compounds are perborates and percarbonates.

Most preferred in the present context is a perborate bleach in the form of particles having on a weight-average basis an average particle diameter of from 0.5 to 20 micrometers, preferably 3 to 15 micrometers.

The small average particle size can best be achieved by in-situ crystallization, typically of perborate monohydrate.

In-situ crystallization encompasses processes involving dissolution and recrystallization, as in the dissolution of perborate monohydrate and subsequent formation of perborate tetrahydrate. Recrystallization may also take place by allowing perborate monohydrate to take up crystal water, whereby the monohydrate directly recrystallizes into the tetrahydrate, without dissolution step.

In-situ crystallization also encompasses processes involving chemical reactions, as when sodium perborate is formed by reacting stoichiometric amounts of hydrogen peroxide and sodium metaborate or borax.

The Water-miscible organic solvent

The suspension system for the solid peroxygen component herein consists in a liquid phase that comprises water and a water-miscible organic solvent. This makes it possible to incorporate in the liquid detergent compositions herein a high amount of solid water-soluble peroxygen compound, while keeping the amount of available oxygen in solution below 0.5% by weight of the liquid phase, preferably below 0.1%. Less than one tenth of the total amount of peroxygen compound is dissolved in the liquid phase; the low level of available oxygen in solution is in fact critical for the stability of the system.

The standard iodometric method (as described for instance in Methoden der Organischen Chemie, Houben Weyl, 1953, Vo. 2, page 562) is suitable to determine the available oxygen (AVO) content of the composition.

In order to ensure complete equilibration between liquid and solid phases, the compositions are to be kept after mixing for three days at room temperature before the AVO titration. Before measuring the products are thoroughly shaken in order to ensure correct sampling.

For the determination of the available oxygen (AVO) in the liquid phase, samples of the compositions are centrifuged for 10 minutes at 10.000 rpm. The liquid is then separated from the solid and titrated for available oxygen.

It is not necessary that the organic solvent be fully miscible with water, provided that enough of the solvent mixes with the water of the composition to affect the solubility of the peroxygen compound in the described manner. Fully water-soluble solvents are preferred for use herein.

The water-miscible organic solvent must, of course, be compatible with the peroxygen bleach compound at the pH that is used. Therefore, polyalcohols having vicinal hydroxy groups (e.g. 1,2-propanediol and glycerol) are less desirable when the peroxygen bleach compound is perborate.

Examples of suitable water-miscible organic solvents include the lower aliphatic monoalcohols; ethers of diethylene glycol and lower monoaliphatic monoalcohols; specifically ethanol, n-propanol; iso-propanol; butanol; polyethylene glycol (e.g., PEG 150, 200, 300, 400); dipropylene glycol; hexylene glycol; methoxyethanol; ethoxyethanol; butoxyethanol; ethyldiglycolether; benzylalcohol; butoxypropanol; butoxypropoxypropanol; and mixtures thereof. Preferred solvents include ethanol; isopropanol, 1-methoxy-2-propanol and butyldiglycolether. A preferred solvent system is ethanol. Ethanol may be preferably present in a water:ethanol ratio of 8:1 to 1:3.

Although the presence or absence of other ingredients plays a role, the amount of available oxygen in solution is largely determined by the ratio water:organic solvent. It is not necessary however to use more organic solvent than is needed to keep the amount of available oxygen in solution below 0.5%, preferably below 0.1%.

In practical terms, the ratio water:organic solvent is, for most systems, in the range from 5:1 to 1:3, preferably from 4:1 to 1:2.

The silicate

The silicates are present in the present composition at levels of from 0.5% to 5%, preferably from 1% to 3%. The addition of silicates at such low levels cannot promote the formation of a structured surfactant phase, but surprisingly allows for an efficient and stable suspension of the peroxygen bleach particles, with only a moderate increase in the viscosity of the composition.

The silicate materials for use herein can be natural silicates with a ratio of $SiO_2$ to Na20 of from 1:1 to 4:1, preferably 1:1 (metasilicate), 1.6:1 or 2:1.

Preferred is sodium silicate, while potassium silicate can also be used.

Synthetic silicates can be used for the purpose of the present invention, such as Sydex® 120, with a ratio of $SiO_2$ to MgO of 3.5:1.

The present liquid detergent compositions with bleach exhibit a pH (1% solution in distilled water) of at least 8 and less than about 11, preferably of at least 9, more preferably at least 9.5. The alkaline pH allows good bleaching action of the peroxygen compound, particularly when the peroxygen is a perborate.

Surfactants

The compositions herein preferably contain a nonionic or cationic surfactant, or a mixture thereof, at total levels of from 1% to 20%, most preferably from 3% to 10%.

The nonionic surfactants are conventionally produced by condensing ethylene oxide with a hydrocarbon having a reactive hydrogen atom, e.g., a hydroxyl, carboxyl, or amido group, in the presence of an acidic or basic catalyst, and include compounds having the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms. They can also be formed by the condensation of propylene oxide with a lower molecular weight compound. n usually varies from about 2 to about 24.

The hydrophobic moiety of the nonionic compound is preferably a primary or secondary, straight or branched, aliphatic alcohol having from about 8 to about 24, preferably from about 12 to about 20 carbon atoms. A more complete disclosure of suitable nonionic surfactants can be found in U.S. Pat. No. 4,111,855. Mixtures of nonionic surfactants can be desirable.

A preferred class of nonionic ethoxylates is represented by the condensation product of a fatty alcohol having from 12 to 15 carbon atoms and from about 4 to 10 moles of ethylene oxide per mole of fatty alcohol.

Suitable species of this class of ethoxylates include.: the condensation product of $C_{12}$–$C_{15}$ oxo-alcohols and 7 moles of ethylene oxide per mole of alcohol; the condensation product of narrow cut $C_{14}$–$C_{15}$ oxo-alcohols and 7 or 9 moles of ethylene oxide per mole of fatty(oxo)alcohol; the condensation product of a narrow cut $C_{12}$–$C_{13}$ fatty(oxo)alcohol and 6,5 moles of ethylene oxide per mole of fatty alcohol; and the condensation products of a $C_{10}$–$C_{14}$ coconut fatty alcohol with a degree of ethoxylation (moles EO/mole fatty alcohol) in the range from 5 to 8. The fatty oxo-alcohols while mainly linear can have, depending upon the processing conditions and raw material olefins, a certain degree of branching, particularly short chain such as methyl branching.

A degree of branching in the range from 15% to 50% (weight %) is frequently found in commercial oxo alcohols.

Preferred nonionic ethoxylated components can also be represented by a mixture of 2 separately ethoxylated nonionic surfactants having a different degree of ethoxylation. For example, the nonionic ethoxylate surfactant containing from 3 to 7 moles of ethylene oxide per mole of hydrophobic moiety and a second ethoxylated species having from 8 to 14 moles of ethylene oxide per mole of hydrophobic moiety. A preferred nonionic ethoxylated mixture contains a lower ethoxylate which is the condensation product of a $C_{12}$–$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$–$C_{19}$ oxo-alcohol with more than 50% (wt) branching and from about 8 to 14 moles of ethylene oxide per mole of branched oxo-alcohol.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

The liquid detergent compositions of the present invention optionally contain a cationic surfactant, preferably from 0.1% to 10%, more preferably 0.1% to 5%, by weight of the composition.

Examples of suitable cationic surfactants include quaternary ammonium compounds of the formula $R_1R_2R_3R_4N^+X^-$, wherein $R_1$ is $C_{12}$–$C_{20}$ alkyl or hydroxyalkyl; $R_2$ is $C_1$–$C_4$ alkyl or hydroxyalkyl or $C_{12}$–$C_{20}$ alkyl or hydroxyalkyl or $C_1$–$C_4$ hydroxyalkyl; $R_3$ and $R_4$ are each $C_1$–$C_4$ alkyl or hydroxyalkyl, or $C_6$–$C_8$ aryl or alkylaryl; and $X^-$ is halogen. Preferred are mono-long chain quaternary ammonium compounds (i.e., compounds of the above formula wherein $R_2$ is $C_1$–$C_4$ alkyl or hydroxyalkyl). Zwitterionic surfactants which could be used in the compositions of the present invention include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulfonates and sulfates disclosed in U.S. Patent No. 3,925,262, Laughlin et al., issued Dec. 9, 1975 and U.S. Pat. No. 3,929,678, Laughlin et al., issued Dec. 30, 1975.

The compositions herein may also contain anionic surfactants. The anionic detergents are well-known in the detergent arts and have found wide-spread application in commercial detergents. Suitable anionic synthetic surface-active salts are selected from the group of sulfonates and sulfates. Preferred anionic synthetic water-soluble sulfonate or sulfate salts have in their molecular structure an alkyl radical containing from about 8 to about 22 carbon atoms.

Accordingly, anionic surfactants, if used, are present at levels up to 40% by weight, preferably from 1% to 30% by weight, even more preferably from 5% to 20% by weight.

Synthetic anionic surfactants, can be represented by the general formula $R_1SO^3M$ wherein $R^1$ represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt forming cation which typically is selected from the group consisting of sodium, potassium, ammonium, and mixtures thereof.

A preferred synthetic anionic surfactant is a water-soluble salt of an alkylbenzene sulfonic acid containing from 9 to 15 carbon atoms in the alkyl group. Another preferred synthetic anionic surfactant is a water-soluble salt of an alkyl sulfate or an alkyl polyethoxylate ether sulfate wherein the alkyl group contains from about 8 to about 24, preferably from about 10 to about 20 carbon atoms, and preferably from about 1 to about 12 ethoxy groups. Other suitable anionic surfactants are disclosed in U. S. Pat. No. 4,170,565, Flesher et al., issued Oct. 9, 1979.

Examples of such preferred anionic surfactant salts are the reaction products obtained by sulfating $C_8$–$C_{18}$ fatty alcohols derived from tallow and coconut oil; alkylbenzene sulfonates wherein the alkyl group contains from about 9 to 15 carbon atoms; sodium alkylglyceryl ether sulfonates; ether sulfates of fatty alcohols derived from tallow and coconut oils; coconut fatty acid monoglyceride sulfates and sulfonates; and water-soluble salts of paraffin sulfonates having from about 8 to about 22 carbon atoms in the alkyl chain. Sulfonated olefin surfactants as more fully described in e.g. U.S. Pat. No. 3,332,880 can also be used. The neutralizing cation for the anionic synthetic sulfonates and/or sulfates is represented by conventional cations which are widely used in detergent technology such as sodium and potassium.

A particularly preferred anionic synthetic surfactant component herein is represented by the water-soluble salts of an alkylbenzene sulfonic acid, preferably sodium alkylbenzene sulfonates having from about 10 to 13 carbon atoms in the alkyl group.

Builders

The present compositions may contain a builder, preferably at a level no more than 50%, more preferably at a level of from 5% to 40% of the total composition.

If present, such builders can consist of the inorganic or organic types already described in the art.

The liquid detergent compositions herein optionally may contain, as a builder, a fatty acid component. Preferably, however, the amount of fatty acid is less than 10% by weight of the composition, more preferably less than 4%.

Preferred saturated fatty acids have from 10 to 16, more preferably 12 to 14 carbon atoms. Preferred unsaturated fatty acids are oleic acid and palmitoleic acid.

Examples of inorganic builders include the phosphourus-based builders, e.g., sodium tripolyphosphate, sodium pyrophosphate, and aluminosilicates (zeolites).

Examples of organic builders are represented by polyacids such as citric acid, nitrilotriacetic acid, and mixtures of tartrate monosuccinate with tartrate disuccinate. Preferred builders for use herein are citric acid and alk(en)yl-substituted succinic acid compounds, wherein alk(en)yl contains from 10 to 16 carbon atoms. An example of this group of compounds is dodecenyl succinic acid. Polymeric carboxylate builders inclusive of polyacrylates, polyhydroxy acrylates and polyacrylates/polymaleates copolymers can also be used, preferably in combination with the preferred builders above, i.e. citric acid and akl(en)yl substituted succinic acid compounds.

Other components/additives

The compositions herein may also contain other components and/or additives at a level preferably less than about 5%. Non-limiting examples of such additives, which can more preferably be used at levels from 0.05% to 2%, include polyaminocarboxylate additives such as ethylenediaminotetracetic acid, diethylenetriamino-pentacetic acid, ethylenediamino disuccinic acid or the water-soluble alkali metals thereof. Other additives useful at these levels include organo-phosphonic acids; particularly preferred are ethylenediamino tetramethylenephosphonic acid, diethylenetriamino pentamethylenephosphonic acid and aminotrimethylenephosphonic acid, hydroxyethylidene diphosphonic acid. Bleach stabilizers such as ascorbic acid, dipicolinic acid, sodium stannates, 8-hydroxyquinoline, hydroxyethylidene diphosphonic acid (HEDP), and diethylenetriamine penta(methylene phosphonic acid) can also be included in these compositions at these levels, more preferably at levels from between 0.01 to 1%.

The compositions herein can contain a series of further optional ingredients which are mostly used in additive levels, usually below about 5%. Examples of the like include: polyacids, enzymes and enzymatic stabilizing agents, suds regulants, opacifiers, agents to improve the machine compatibility in relation to enamel-coated surfaces, bactericides, dyes, perfumes, brighteners, softeners and the like.

As described above, detergent enzymes can be used in the liquid detergent compositions of this invention. In fact, one of the desirable features of the present compositions is that they are compatible with such detergent enzymes. Suitable enzymes include the detergent proteases, amylases, lipases and cellulases. Enzymatic stabilizing agents for use in liquid detergents are well known. Enzyme stabilizing agents, if used, are preferably in a range of from about 0.5% to 5%. Preferred enzymatic stabilizing agents for use herein are formic acid, acetic acid, and salts thereof, e.g. sodium formate and sodium acetate. More preferred stabilizing agents are sodium formate end acetic acid.

Use of the compositions

The present compositions are mainly intended to be used in the wash cycle of a washing machine; however, other uses can be contemplated, such as pretreatment product for heavily-soiled fabrics, or soaking product; the use is not necessarily limited to the washing-machine context, and the compositions of the present invention can be used alone or in combination with compatible handwash compositions.

Some typical liquid detergent compositions of the present invention have the following formulae:

| Ingredients | composition wt % | | | | | |
|---|---|---|---|---|---|---|
| | I | II | III | IV | V | VI |
| Linear alkyl benzene sulfonate | 10 | 12 | 10 | 8 | 10 | 12 |
| $C_{13}$–$C_{15}$ alcohol ethoxylated ($EO_3$) | 5 | 0 | 0 | 10 | 5 | 3 |
| $C_{13}$–$C_{15}$ alcohol ethoxylated ($EO_7$) | 0 | 7 | 5 | 0 | 2 | 4 |
| Citric Acid | 2.5 | 3.5 | 4 | 1 | 2.5 | 3 |
| Dodecenyl succinic acid | 8.5 | 7 | 6.5 | 10 | 8.5 | 8 |
| Polymeric carboxylate builder | 1.5 | 1.5 | 2 | 1.5 | 1.5 | 1 |
| Tallow fatty acid | — | 1.5 | 2 | — | — | 1 |
| Diethylenetriamino penta(methylenephosphonic acid) | 0.5 | 0.5 | 0.4 | 0.5 | 0.5 | 0.4 |
| Hydroxyethylidene diphosphonic acid | 0.2 | 0.2 | 0.3 | 0.2 | 0.3 | 0.4 |
| Sodium formate | 1.5 | 1 | 1.5 | 1.5 | 1 | 2 |
| Acetic acid | 1.4 | 1.5 | 1.4 | 1.4 | 2 | — |
| Ethanol | 8 | 10 | 12 | 10 | 14 | 14 |
| Sodium perborate monohydrate | 14 | — | 14 | — | — | 14 |
| Sodium perborate tetrahydrate | — | 20 | — | 22 | 20 | — |
| Silicate $SiO_2$ to $Na_2O$ ratio 1.6 | 1 | 3 | — | — | — | — |
| Silicate $SiO_2$ to $Na_2O$ ratio 2.0 | — | — | 1.5 | 3 | — | — |
| Sydec ® 120 | — | — | — | — | 1 | 4 |
| Sodium hydroxyde | | | up pH 9.5 | | | |
| Water + minors (perfume, brightener, enzymes, . . . ) | | | balance to 100 | | | |

I claim:

1. A stable liquid detergent composition having a pH of at least 8 and less than about 11 and comprising from about 5% to about 50% by weight of a solid, water-soluble peroxygen compound selected from perborates and percarbonates wherein said water-soluble peroxygen compound is suspended in a liquid phase containing water and at least one water-miscible organic solvent, the amount of the solid water-soluble peroxygen compound and the ratio of water to organic solvent being such that the amount of available oxygen provided in solution by said peroxygen compound is from 0.5% to 3%, said compositions also containing from 1% to 3% by weight of a silicate suspending agent of said peroxygen compound and wherein said water-soluble peroxygen compound is in the form of solid particles having a weight average particle diameter ranging from 0.5 to 20 microns.

2. A detergent composition, according to claim 1, wherein the silicate suspending agent is selected from sodium silicate and potassium silicate.

3. A liquid detergent composition according to claim 1 wherein the water-miscible organic solvent is an aliphatic monoalcohol.

4. A liquid detergent composition according to claim 2 wherein the water-miscible organic solvent is ethanol, and the water:ethanol ratio of from 8:1 to 1:3, preferably 5:1 to 1:2.

5. A liquid detergent composition according to claim 1, 2 or 3 wherein the solid, water-soluble peroxygen compound is perborate tetrahydrate, and present at levels of from 5% to 30% by weight of the total composition.

6. A composition according to claim 5 wherein the perborate tetrahydrate particles have been formed by recrystallization of a perborate monohydrate.

7. A composition according to claims 1, 2, 3 or wherein the solid, water-soluble peroxygen compound is a percarbonate.

8. A liquid detergent composition according to claim 2 wherein the water-miscible organic solvent is an aliphatic alcohol.

9. A stable liquid detergent composition having a pH of at least 8 and less than about 11 and comprising:

a) up to about 40% by weight of a detersive surfactant selected from anionic, nonionic, cationic, and zwitterionic surfactants and combinations of said surfactant types;

b) from about 5% to 50% by weight of a water-soluble peroxygen compound selected from perborates and percarbonates, wherein said water-soluble peroxygen compound is in the form of solid particles having a weight average particle diameter ranging from 0.5 to 20 microns;

c) from about 1% to 3% by weight of a silicate suspending agent for said peroxygen compound particles; and d) a liquid phase comprising a mixture of water and a water-miscible organic solvent in a ratio of water to solvent suitable to permit no more than 0.5% available oxygen in solution from dissolved peroxygen compound.

10. A composition according to claim 9 wherein the liquid phase comprises water and ethanol is a water to ethanol ration ranging from 5:1 to 1:3.

11. A composition according to claim 9 which contains one or more additional components selected from:

a) up to 50% by weight of a non-silicate builder;

b) up to 5% of a detergent enzyme component; and c) up to about 5% of additives selected from enzyme stabilizer, suds regulators, opacifiers, bactericides, dyes, perfumes, brighteners, softeners, and combinations of said additives.

* * * * *